US006050351A

United States Patent [19]

Eckenfels et al.

[11] Patent Number: 6,050,351

[45] Date of Patent: Apr. 18, 2000

[54] DRILLING HOLE SYSTEM FOR HORIZONTAL BOREHOLES

[75] Inventors: Josef Eckenfels, Durbach; Herbert Haas, Oberkirch, both of Germany; Norbert Prinz, Colmar, France; Christian Wartel, Paris, France; Dominique Pfeiffer, Ermenonville, France

[73] Assignee: Gaz de France (G.D.F.) Service National Powerdrill GmbH Und Co KG, France, Germany

[21] Appl. No.: 08/922,574

[22] Filed: Sep. 3, 1997

[30] Foreign Application Priority Data

Sep. 9, 1996 [FR] France ..... 96 10978

[51] Int. Cl.[7] ..... E21B 7/04

[52] U.S. Cl. ..... 175/62; 175/78

[58] Field of Search ..... 175/62, 77, 78, 175/40

[56] References Cited

U.S. PATENT DOCUMENTS 4,542,796 9/1985 Delbarre .
4,630,967 12/1986 Soltau .
5,133,418 7/1992 Gibson et al. ..... 175/45
5,584,351 12/1996 Ellicott ..... 175/62

FOREIGN PATENT DOCUMENTS 0270458 6/1988 European Pat. Off. .
2276895 10/1994 United Kingdom .

*Primary Examiner*—William Neuder
*Assistant Examiner*—Zakiya Walker
*Attorney, Agent, or Firm*—Rothwell, Figg, Ernst & Kurz

[57] ABSTRACT

A drilled hole (1) is produced by means of a drilling rod assembly comprising a succession of rod elements (7*d*) to be arranged end to end. For this purpose, a vertical shaft (2) is produced in the ground, of constant horizontal section and preferably insufficient for a man to be able to work towards the bottom of it, the rod assembly is displaced therein from an opening located in a front wall of the shaft, and the elements (7) of the rod assembly are selected so that they have an axial length less than the distance separating the said opening in the front wall of the shaft from the opposite rear wall.

8 Claims, 8 Drawing Sheets

DRILLING HOLE SYSTEM FOR HORIZONTAL BOREHOLES

FIELD OF THE INVENTION

The invention concerns a process and an apparatus for drilling holes.

DESCRIPTION OF THE BACKGROUND ART

With respect to the present state of the prior art on the subject, the object of the invention is to achieve the following aims:

- to be able to work in narrowly confined locations, in particular in an urban environment where the overall dimensions of the apparatus must be as small as possible, causing the least possible inconvenience,
- to obtain reliable operation of the apparatus, without the risk of breakage of the apparatus, substantially whatever the conditions encountered on the terrain,
- that the apparatus should be as functional and simple as possible as regards construction and use,
- to permit limited manufacturing and operational costs,
- to allow optimum control and guiding of the drilling, in a simple and functional manner,
- to limit as far as possible the risks of disturbance of the subsoil during drilling of the hole by the apparatus.

Until now it has been proposed, to drill an essentially horizontal hole in the ground, to use a drilling rod assembly comprising a succession of drilling rod elements arranged end to end along an axis and capable of being pushed forwards, in the ground, by a drilling drive device.

Thus, a drilling machine has already been used to sink, from the surface of the soil into the sub-soil, on an inclined path, a rod assembly constituted of a large number of drilling stems or rods, screwed end to end to one another, and each being several meters in length. The direction of penetration (that is to say, of the drilling head which is at the forward end of the rod assembly) can be relatively well adjusted, so that drilling takes place first flat and obliquely downwards, until the prescribed depth is reached, then drilling is continued in an essentially horizontal direction, still by means of the guiding of the drilling head.

For drilling, the rod assembly is pushed forwards by the drilling drive device fixed to the rod assembly at the front. This rod assembly is often driven in rotation, and/or, under the action of the water which escapes from the drilling head under high pressure. The materials encountered during drilling are then expelled, most often through an internal hollow passage provided through the rod assembly.

This process is used especially for laying pipe systems over long sections, for example of 100 meters or more.

Such a drilling apparatus, which among other things must have a mounting directed obliquely downwards to guide the rod assembly, is large and weighs at least two tonnes, since the weight of the drilling machine serves in part as a stop for the force serving for the forward compression of the rod assembly.

It is considered that known drilling apparatuses, a typical example of which has just been described, do not reasonably satisfy at least the essential aims assigned here.

SUMMARY OF THE INVENTION

In order to remedy this defect and to tend towards the aims set, the invention first proposes, in order therefore to produce an essentially horizontal drilled hole, in the ground, by means of a drilling rod assembly comprising a succession of drilling rod elements to be arranged end to end along an axis and capable of being pushed forwards, in the ground, by a drilling drive device,

- to produce the said starting region as an open shaft in the ground on a substantially vertical axis with a substantially constant horizontal section over the depth of the shaft, while being preferably insufficient for a man to be able to work towards the bottom of it with the said drilling assembly,
- in order to dig the hole, to displace the rod assembly, in the hole, by elements, in the direction of the hole, from an opening located in a front wall of the shaft,
- and to select the elements of the rod assembly so that they have an axial length less than the distance separating the said opening in the front wall of the shaft from the opposite rear wall.

This offers the possibility of producing the rod assembly from very short drilling rods (approx. 10 to 30 cm.) which will advantageously be screwed to one another.

The individual drilling rods will then be flexible only in their central region, that is to say, not in their end region for screwing to the two adjacent rods. There will preferably be no play in the screwing, since this would result in the elimination of the possibility of adjusting the orientation of the rod assembly as a whole. As a rod assembly constituted of tubes is much more rigid in the actual screwing region, without play, than in the central region of the individual rods, the rod assembly, in the screwing regions, may be regarded as substantially unable to undergo lateral displacement.

Consequently, an assembly constituted of rods in which the screwing regions represent approximately 20 to 25% of the total length of each rod should be regarded generally as being not very resilient in a transverse direction.

Owing to the fact that, for the majority of the drilling operations to be carried out within the framework of the invention, only a very small lateral deviation of the drilling will be necessary, the rod assembly constituted of a very large number of very short individual rods is appropriate. It will in fact thus be possible, commencing from a starting shaft having a section at the bottom which will not be substantially greater than the small predetermined section at the surface of the ground, to achieve horizontal advancement with a rod assembly in which the individual rods are connected, in the direction of the drilling axis, to the rear end of the rod assembly in place. The length of the individual rods will then be distinctly shorter than the length, measured in the horizontal plane, of the cross-section of the starting shaft.

And, in order to displace the rod assembly in the drilled hole, the drive device will advantageously be pressed against the wall of the shaft opposite to the opening of the hole and a forward thrust will be exerted on the elements in the hole, by means of the drive device.

Moreover, the apparatus provided in the invention, in order to produce the desired drilled hole, comprises:

- a framework suitable for being lowered, at least in part, into the shaft,
- drilling rod elements to be arranged end to end, being individually of a specific length,
- drilling drive means displaceable in the framework between two positions, forward and rear, in order to drive the drilling rod elements and to create, while advancing, an assembly of rod elements which are relatively rigid along a substantially horizontal axis,
- the said length of the elements constituting the said assembly of rod elements which is created being less than a width which the said framework has along the axis of the rod assembly.

With regard to the drilling drive means, the latter will advantageously comprise:

clamping means for clamping individually the last rod element(s) constituting the said drilling rod assembly, thrust means, for advancing the said rod assembly by compression, along its axis in the drilling direction, and loading/extracting means movable in the said framework between a high position and a low position in order, in one direction, to bring additional rod elements to the drilling drive means so as to lengthen the rod assembly and, in the opposite direction, to extract elements from the rod assembly, therefore to shorten it.

By the use of a very stable rod assembly, in particular by means of rods of a solid material, or at least of tubes having a very considerable wall thickness, it will thus be possible to carry out drilling essentially (and if necessary, exclusively), by advancing the rod assembly by compression. This method of proceeding is particularly well suited to work carried out commencing from a starting shaft, since the drive device intended to advance the rod assembly by compression can easily bear against the opposite wall of the shaft.

The drilling drive device may additionally comprise a passage opening for the rod assembly, such that the drilling drive device, contrary to what is customary elsewhere, does not act frontally on the rear end of the rod assembly, but instead grasps the rod assembly on its outer periphery, and maintains it in position about the longitudinal axis, exclusively by a dynamic connection, both in the axial direction and in the angular position, which makes it possible to push the rod assembly forwards, rotate it, or draw it back.

Thus, in order to displace the drilling rod assembly in the hole, it is advisable to:

clamp by means of the drive device the outer periphery of a rear element of the said assembly located in the shaft, to advance this element towards the hole, along the axis of the rod assembly, by a length corresponding substantially to the length of the element, and, while retaining the rod assembly already in the drilled hole in order to prevent it from moving back, to grasp another rear element of the rod assembly, and so on, element by element.

Rotation of the rod assembly, in order to scrape or "mill" the ground material ahead of the drill head is of interest only in particular cases. It is necessary, however, to be able to rotate the rod assembly through an angle of less than 360°, since it is possible to act on the direction of advancement of the drilling by way of an asymmetrical bevel, present at the point of the rod assembly, and its angular position with respect to the drilling axis.

Owing to the placing of the drilling rod in position in the direction of the drilling axis (which is essentially horizontal), it is additionally possible to introduce into the starting shaft, or to remove from the latter, the new rods to be inserted or removed, from this horizontal position, from a magazine. Thus, the difficulties entailed in modification of the direction of the rods when they are being fed in, such as jamming etc., for example, are almost completely avoided.

By means of a drilling rod changer (which will preferably be referred to as a "loader/extractor"), which has a motor of its own, the rods to be added can each be screwed onto the rear end of the rod assembly. Advantageously, the rods will first be drawn, by means of the motor of the loader/extractor and of the threaded sleeve fixed thereto, from the rod magazine located above.

The drilling drive device can undergo longitudinal translation in one direction and the other in the starting shaft, parallel to the drilling axis, at least over the length of an individual rod. Preferably, the drilling drive device can thus be displaced in one direction and the other between an advanced position, which is located immediately at the start of the drilled hole in the starting shaft, and a withdrawn position, which is located in the vicinity of the rod loader/extractor device, itself arranged against the opposite wall.

Both the loader/extractor and the drilling drive device are preferably installed in a drilling tower or framework, which is constituted of a latticework of metal tubes, one part of which can be fixed and another movable in a vertical direction. The framework will preferably be covered by plates on its peripheral walls in order to prevent earth from falling into the starting shaft. This drilling tower (or at least its movable part) is lowered, for example by means of a hand winch, from the top of the shaft.

The drilling rod magazine may be constituted by a vertical or inclined chute in which the drilling rods are arranged horizontally one above the other. In the lowest position, the chute is open at the front, in order to allow the lowermost rod to be taken from the magazine. In this removal position, the drilling rod is located vertically with respect to a section of the drilling axis, and it can therefore be picked up by the rod loader/extractor, which can be displaced vertically with respect to the drilling tower.

To this end, the changer carriage on which the motor of the loader/extractor is also situated, is raised to the height of the removal position. The threaded sleeve provided on the shaft of this motor is then introduced by screwing into the drilling rod located in the position for removal from the rod magazine. It should be noted that this rod cannot be driven in rotation, because of the other rods resting on it, or even an additional mass. After lowering to the drilling axis, a rotation in the opposite direction, and a forward thrust of the above-mentioned motor with the drilling rod taken from the magazine, serve to screw the rod onto the rear end of the rod assembly located in the drilled hole. The rod magazine preferably ends in the drilling tower below the surface of the ground, but starts above the bottom surface and can then additionally project obliquely beyond the rod assembly from the drilling tower, in order to facilitate the loading, by hand, of additional rods.

The lower part of the tower is advantageously wedged inside the starting shaft by horizontally acting clamping hydraulic cylinders, for correct holding not only in the horizontal plane but also in the vertical plane.

BRIEF DESCRIPTION OF THE DRAWINGS

An exemplary embodiment of the invention is described in more detail hereinafter with reference to the Figures, in which.

DETAILED DESCRIPTION OF THE PREFERRED EMBODIMENTS

Figure 1A:
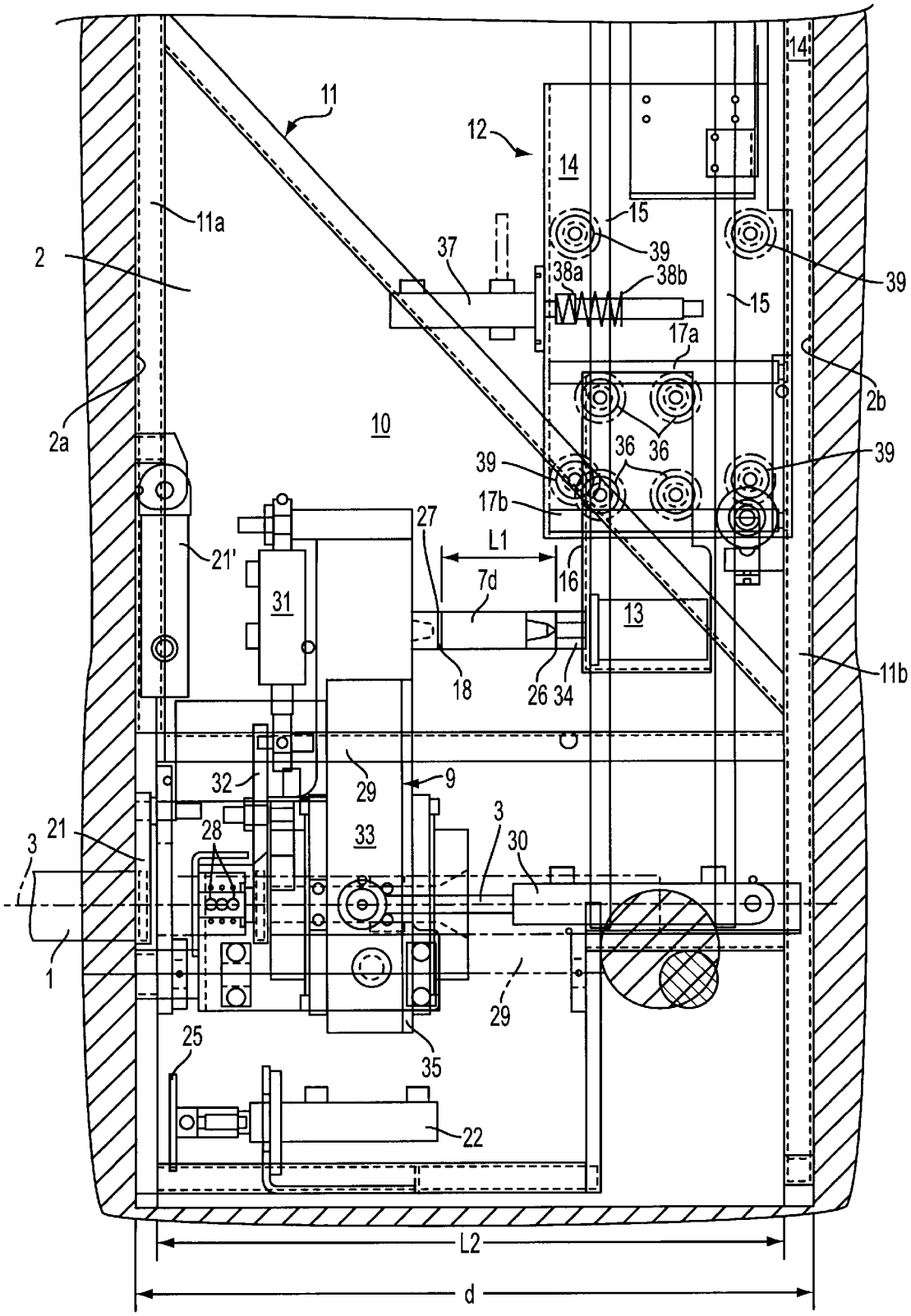
FIGS. 1*a* and 1*b* show in side view the lower and upper parts respectively of the drilling apparatus according to the invention.
Figure 1B:
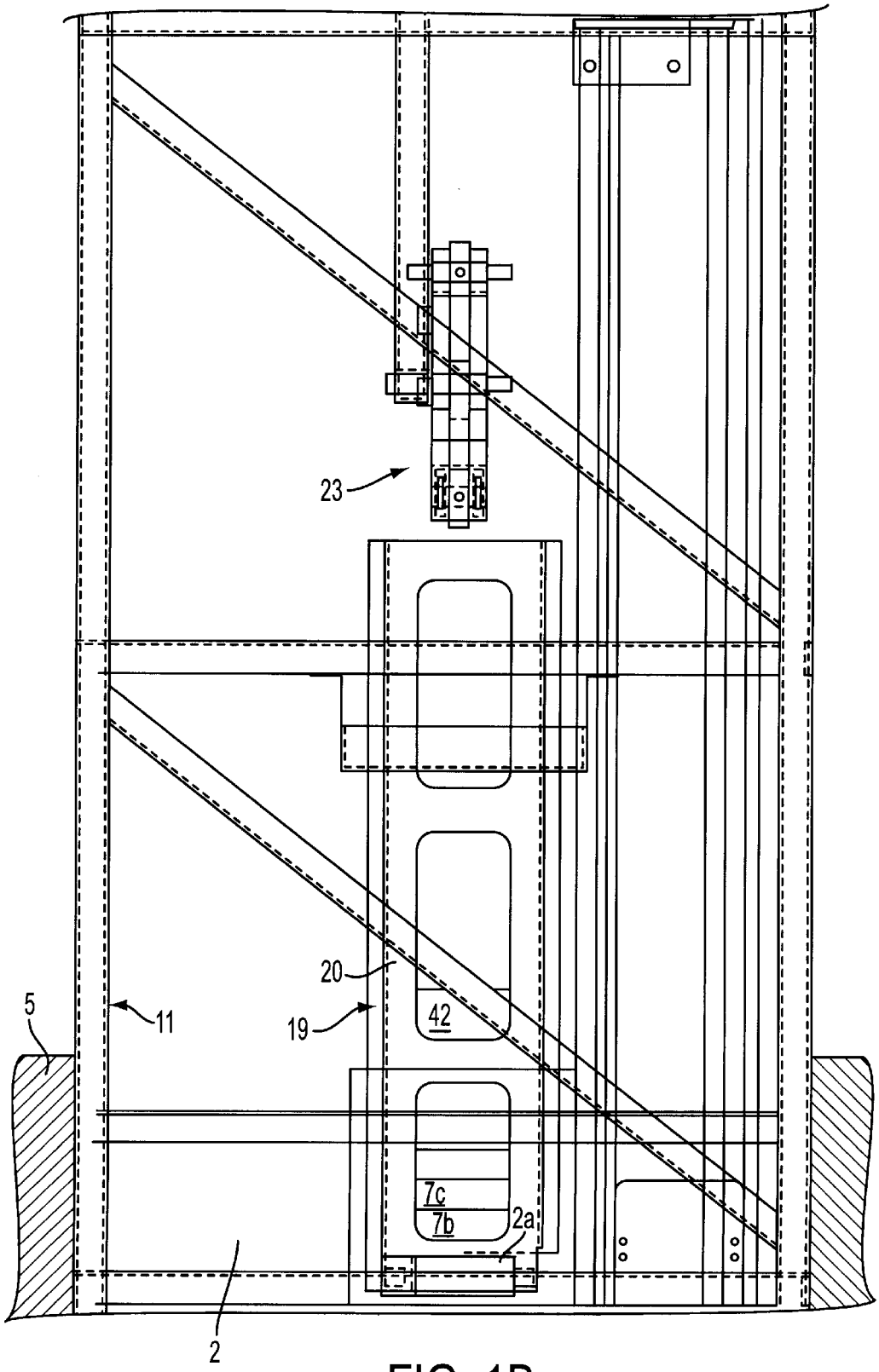
Figure 2A:
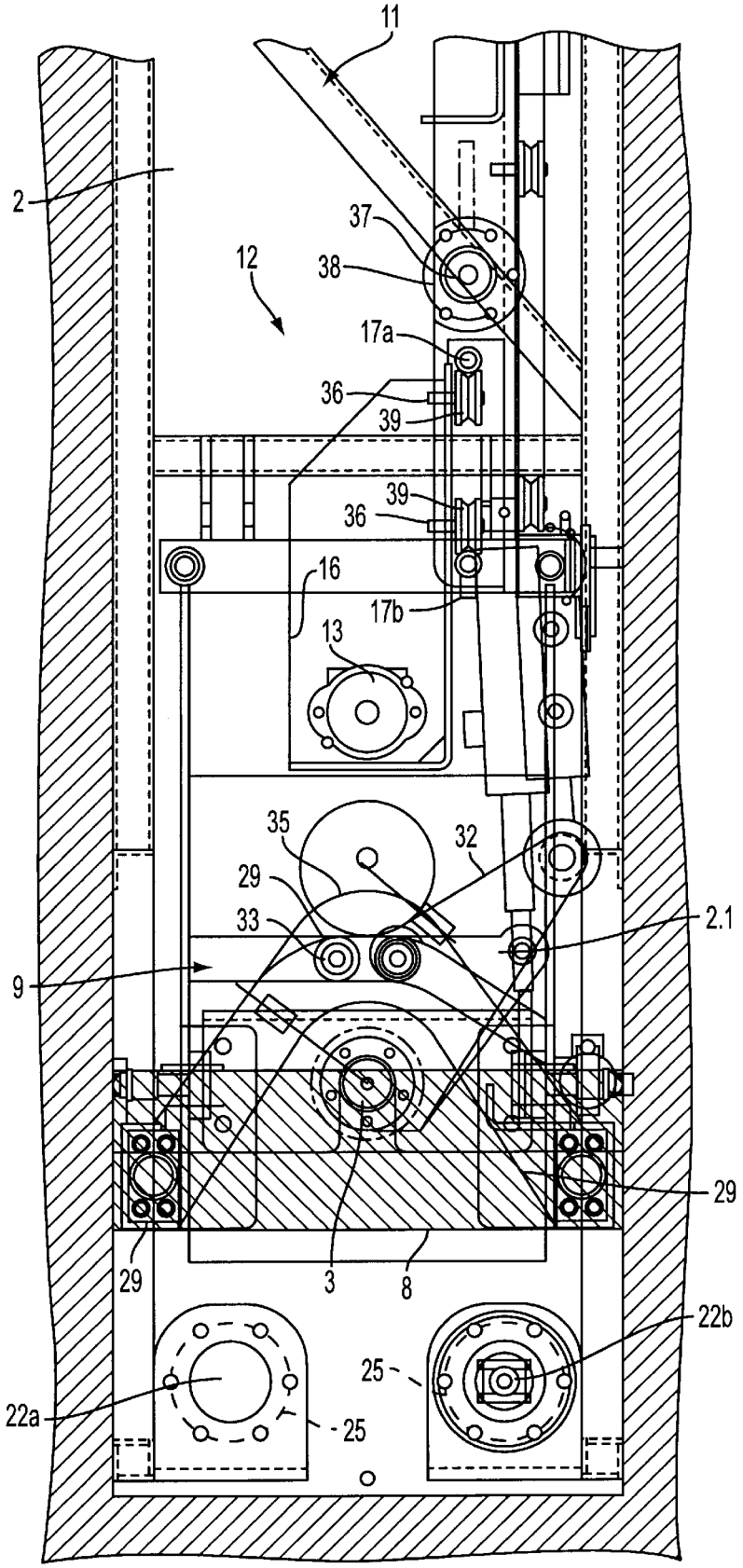
FIGS. 2*a* and 2*b* show the lower and upper parts respectively of the apparatus according to the invention from the front, when seen on the drilling axis.
Figure 2B:
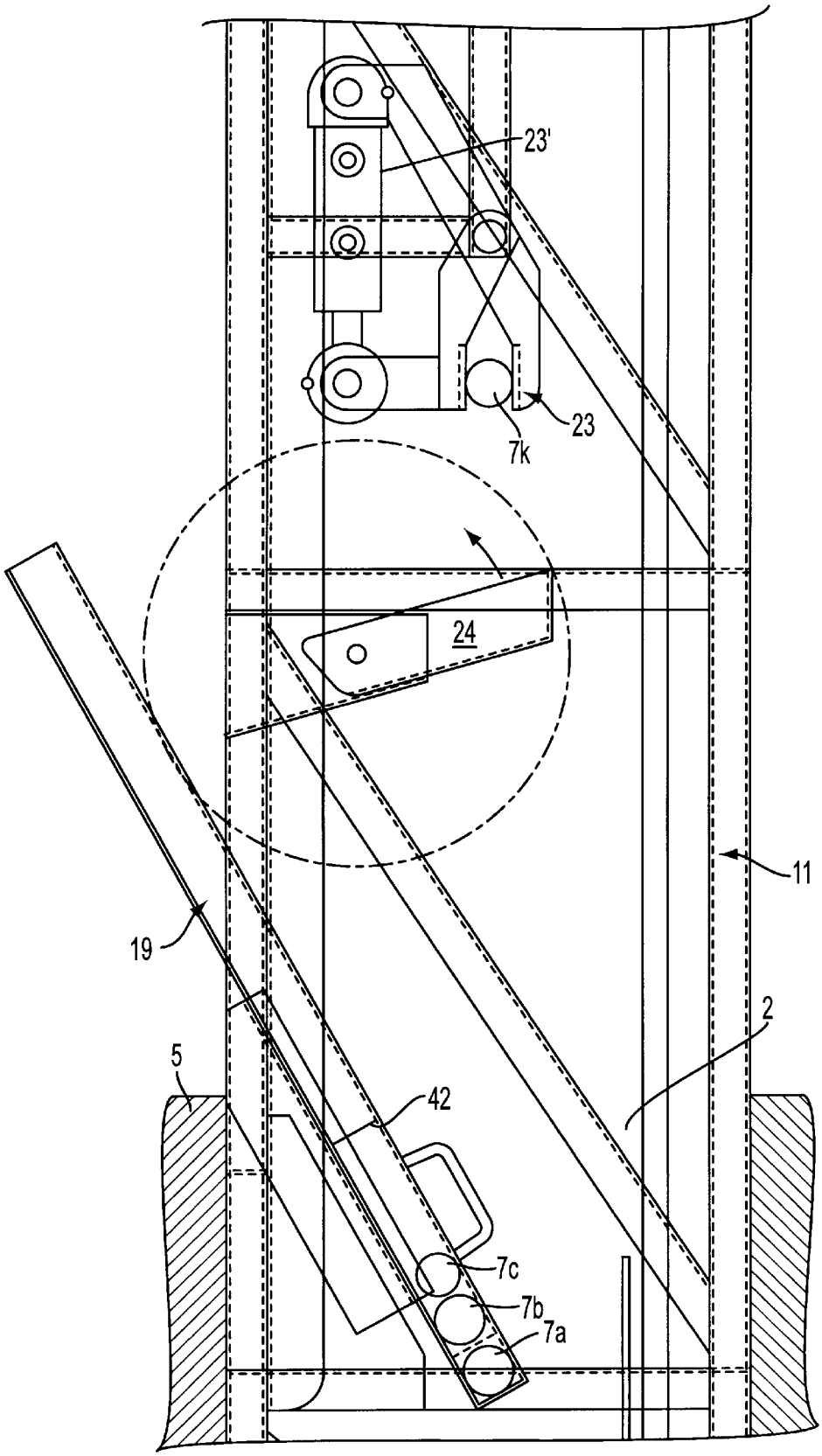

In FIGS. 1 and 2, FIGS. 1*a* and 2*a*, respectively, each show the lower part of the drilling apparatus located in the starting shaft 2, while FIGS. 1*b* and 2*b*, respectively, show its upper part which partially projects from the surface of the ground 5.

The elements of the apparatus are arranged inside a tower 11, produced from metal profile sections, the outer surfaces of which are preferably covered, in a manner not shown in the drawing, by metal plates.

The drilling tower 11 is lowered into the starting shaft 2, for example by means of a hand winch, not shown in the drawings, and to this end may be guided vertically, for example in an auxiliary frame arranged above the starting shaft, by means of guide rollers, slides, etc.

In the lower part of FIG. 1*a* there can be seen, extending horizontally, the drilling axis 3, and the drilled hole 1 provided in the left-hand side wall 2*a* (front wall).

The tower 11 has recesses open at the bottom, provided in these side walls.

The principal elements of the apparatus according to the invention are all arranged against or in the drilling tower 11:

- the drilling drive device 9, which presses the rod assembly 6 forwards towards the left, in the direction of the drilling axis 3, or which, during the extraction of the drilling rod assembly 6 from the drilled hole 1, draws the assembly 6 back,
- the rod loader/extractor 12, which makes it possible to adapt, element by element, the length of the rod assembly 6 located in the hole 1, by the addition or withdrawal of additional rods 7 at its rear end,
- the rod magazine 19, in which are housed the rods 7 intended to be connected to the rod assembly 6,
- and also the inclined chute 24, in which the rods 7 taken from the rod assembly 6 drop in order to be cleaned therein by the operating personnel, be subjected to checking for deterioration and be re-lubricated for later use.

Figure 3:
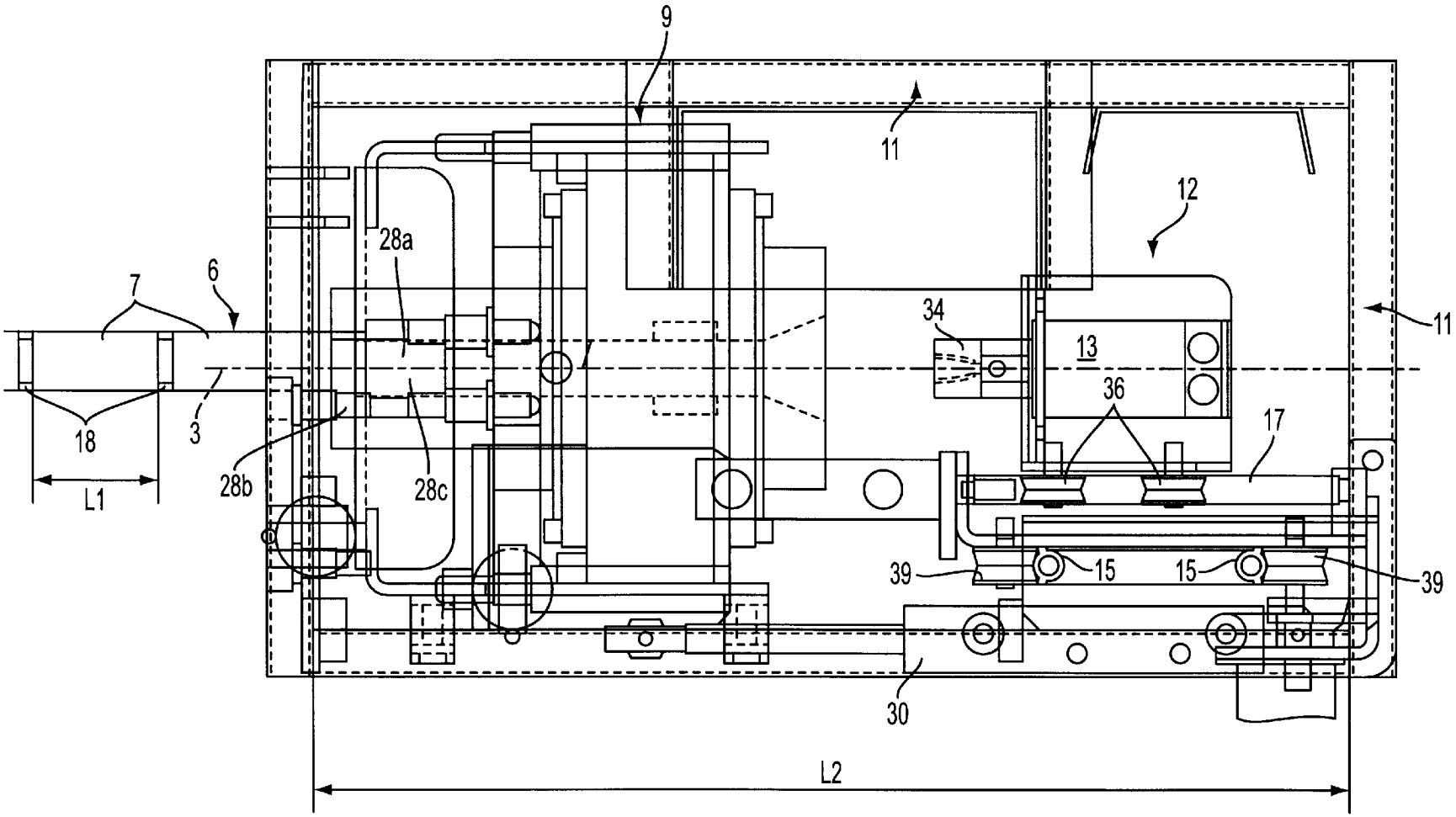
FIG. 3 shows the apparatus in an enlarged top view.

FIGS. 1 and 2 do not include any rod assembly 6 on the drilling axis 3 in order to make it easier to understand the drawings, unlike FIG. 3. It can then be seen that the rod assembly 6 is constituted by rods 7 (or elements) arranged one behind the other, screwed to one another at their ends. Each element 7 has an axial length L1 (FIGS. 1*a* and 3) less than the distance d separating the front wall 2*a* and the rear wall 2*b* of the shaft where the drilling machine has been installed, and than the length L2 (measured parallel to the axis of the rods 7) of the framework 11 (or at least of its part which descends into the shaft), between its vertical lateral front and rear columns, having the references 11*a*, 11*b* in FIG. 1*a*.

In FIG. 1*a*, one of these rods, 7*d*, is screwed to the threaded sleeve 34 of the motor 13 belonging to the loader/extractor device 12.

Each threaded rod 7 has on its outer periphery an annular groove 18 acting as detecting means.

As can be seen in FIG. 1*a*, the loader/extractor 12 is displaced essentially vertically. The drilling rod 7*d* is then displaced in an essentially vertical transport gap 10. The drilling drive device 9 can slide, on the drilling axis 3, along guides 29 by means of hydraulic pistons 30.

In order to press the rod assembly 6, and therefore to advance the drilling, the drilling assembly drive device 9 grasps the rod 7 located furthest to the rear (that is to say, still in the region of the drilling tower 11) and the whole of the drilling drive device 9 is displaced towards the left, by way of the position shown in FIG. 1*a*. The drilling drive device 9 is thus displaced alternately between the front wall 2*a* and the vicinity of the opposite rear wall 2*b*.

The device 9, in addition to this axial movement in the direction of the drilling axis 3, can also rotate the rod assembly 6, both during the linear movement and separately. To this end, a rotating jaw 33, capable of clamping the rod assembly, can rotate or pivot with respect to its housing 35, coaxially with the drilling axis 3. This method of proceeding serves to adjust the orientation, in co-operation with a bevel of known type arranged asymmetrically against the point of the rod assembly.

The drilling drive device includes another jaw 32, termed a "separating" or "unlocking" jaw, arranged ahead of the rotating jaw 33, and which can maintain the rod assembly fixed in rotation with respect to the casing 35 of the drilling drive device.

An additional clamping jaw 21 is also arranged integrally with the drilling tower 11, in the immediate vicinity of the drilled hole 1 with respect to the rod assembly 6. This clamping jaw 21, as can be seen more easily in FIG. 2*a*, is also constituted by two jaws, directed transversely against the rod assembly. These jaws are driven by a hydraulic jack 21' which is held, by one of its ends, in a fixed position relative to the drilling tower 11.

At the lower end of the tower, still below the drilling drive device 9, clamping cylinders 22*a*, 22*b*, extending in the direction of the drilling axis 3, are arranged in a stationary manner against the drilling tower 11. The cylinders 22*a* and 22*b* have a compression plate 25 at the free end of their piston rod. Since the drilling tower 11, in this region, has no outer covering, the outlet of the piston rods of these clamping cylinders 22 (which if necessary are driven by a hydraulic device), compress their compression plates 25 against the opposite wall of the starting shaft 2, and thus the drill tower 11 against the side walls of the shaft 2. Thus, the whole of the drilling tower 11 is fixed in the starting shaft 2, which is important for the alignment, relative to the started drilled hole 1, of the drilling axis 3 defined by the drilling drive device 9 relative to the drilling tower 11.

The loader/extractor 12 is essentially constituted by the motor 13 with its threaded sleeve 34, which is preferably arranged directly on the output shaft of the motor. The sleeve 34 is provided with a screw thread capable of being screwed onto the rear screw thread of the rods 7, so as to allow them to be assembled end to end. As can be seen in FIG. 1*a*, the screw thread is then preferably an external screw thread, applied along a conical surface, on the drilling rod 9, in which case a form of circular threads is preferably used. The threaded sleeve 34 consequently has an internal screw thread in the opposite direction, and the motor 13 is orientated, by its axis of rotation, parallel to the axis 3. The motor 13 can then be displaced both in the direction of the drilling axis 3 and perpendicularly to this direction (vertically along the framework 11).

To this end, the motor 13 is fixed to a motor frame 16. The frame 16 can be displaced, by means of rollers 36 having an annular groove on their outer periphery, in the direction of the drilling axis 3, along two bars preferably spaced vertically from each other, acting as guides 17 for the frame of the motor. The guides 17 are fixed on a carriage 14 which, preferably by means of rollers 39, can be displaced in the vertical direction along the carriage guides 15 in the form of bars arranged, in the direction of the drilling axis 3, at a certain distance in the drilling tower 11, in the vicinity of the side 2*b*.

The motor 13, by means of the loader/extractor elevator carriage 14, can be displaced in the vertical direction so as to be aligned either with the drilling axis 3, in its lowest position, or, in its highest position (FIG. 2*b*), with a gripper device 23, arranged in the upper region of the drilling tower 11. This gripper device is actuated by means of a hydraulic jack 23', preferably double-acting. Between these two end positions (both preferably located below the level of the surface of the ground 5), there is to be found, on the trajectory of the motor 13, the position for removal from the magazine 19 where "new" drilling rods 7*a*, 7*b*, 7*c* are ready. The magazine is essentially constituted by a sheath 20 of the profiled type arranged in an inclined position, the inclination increasing at maximum to a vertical position. The drilling rods 7 are installed therein from above.

At its lower end, the sheath 20 has a stop for the lowermost drilling rod 7*a* and is open at the rear side of this rod directed towards the motor 13.

The magazine 19 then projects preferably above the level of the ground 5, and extends towards the outside or laterally relative to the drilling tower 11, so that the operating personnel can fill it more easily with the drilling rods 7.

When the motor 13 is in alignment with the drilling rod 7*a* lodged in the position for removal from the magazine 19, the motor 13, by means of longitudinal displacement along its axis of rotation, accompanied by rotation of the threaded sleeve 34, can be be screwed onto the drilling rod 7*a*. Rotation of the latter is prevented by the weight of the drilling rods arranged above, and optionally by the weight of a mass 42, also arranged in the magazine 19. The descent towards the drive device 9 of the motor 13, with the drilling rod 7*a*, effects the transfer of the rod to the rod assembly 6, for connection.

Above the lower end of the magazine 19, in the vertical trajectory of the drilling rods thus transported, and below the gripper device 23, the inclined chute 24 is arranged in such a manner that its upper end is still below the gripper device 23. A drilling rod 7, driven in the gripper device 23 from above by means of the loader/extractor 12, then moves away the inclined chute 24, which can be tilted towards the outside about a pivoting axis, from this trajectory. Then the inclined chute 24 returns, by reason of the force of gravity, tilted as far as the operating position shown in FIG. 2*b*. In this operating position, the drilling rods 7*k*, held at first by the gripper device 23, drop into the inclined chute 24 after being released, and roll along, emerging laterally from the drilling tower 11, where they are received by the operating personnel for checking and storing.

Figure 4:
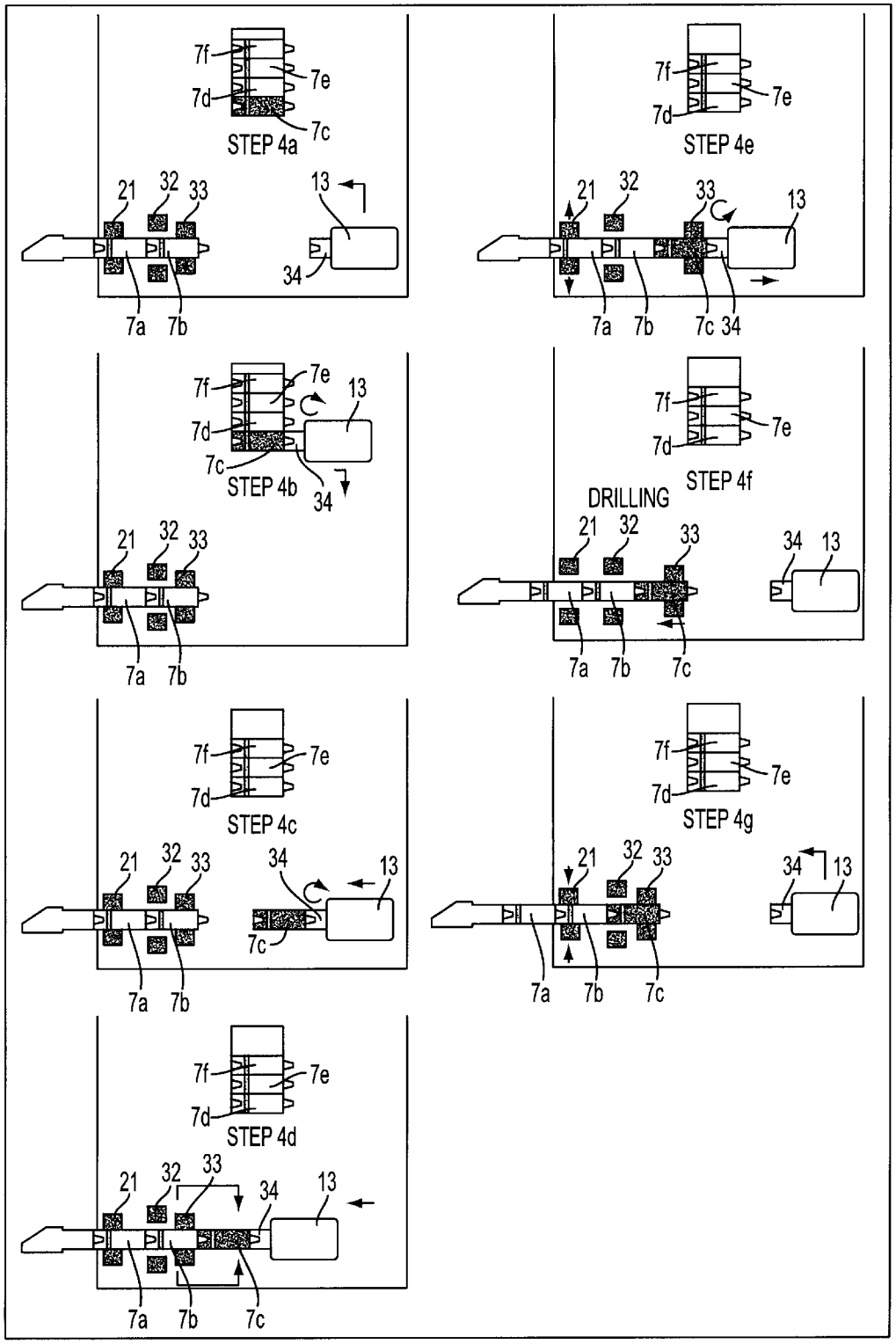
FIG. 4 is a block diagram of the operation of the process using the device of the invention for a drilling operation, separated into steps 4*a* to 4*g*.

A description will now be given of the operation of the device according to the invention, in particular with reference to FIGS. 4 to 6.

It starts from a drilling operation already commenced, which it is wished to continue.

In this case, the carriage 14 of the device 12 is displaced upwards (step 4*a*) to take a new drilling rod element 7*c* from the magazine. The motor frame 16 is then located with the motor 13, in the rear position brought back horizontally furthest from the drilled hole, that is to say, towards the right-hand edge 2*b* of the starting shaft 2 in FIG. 1*a*.

The carriage 14 is then displaced upwards along the guides 15 until the threaded sleeve 34 comes into alignment with the screw thread of the rod 7*c*, located in the position for removal from the magazine 19. The threaded sleeve 34 is then displaced on its axis of rotation towards the left, that is to say, towards the front, against the drilling rod 7*c*, and is driven in rotation by the motor 13 (step 4*b*) in such a manner as to screw the threaded sleeve 34 to the drilling rod. This screwing operation is limited to a certain duration, of a few seconds, by a timing mechanism coupled to the loader motor 13.

In order to permit the engagement of the screw thread of the threaded sleeve 34 and of the drilling rod 7*c*, there must be a pressure in the axial direction. To this end, the threaded sleeve 34 is displaced horizontally in the axial direction by means of the motor 13, owing to the fact that the motor frame 16 is displaced substantially horizontally relative to the carriage 14 along the guides of the motor frame 17*a*, 17*b*. The hydraulic piston 37 carries out this operation.

Since the extension and the retraction of this hydraulic piston 37 cannot be controlled with the precision corresponding to the axial advance during the screwing of a screw thread at a perfectly defined rotation speed, a spring 38 is interposed between the hydraulic piston 37 and the motor frame 16 which moves under the action of the latter, and there is preferably a spring 38*a*, 38*b* for each direction of movement. The necessary length compensation in the direction of the drilling axis 3 is thus ensured.

Moreover, in order to compensate for the faults in alignment between the axis of rotation of the threaded sleeve 34 and the drilling rod 7*c* located in the magazine, the threaded sleeve 34 is preferably arranged in a stationary manner on the output shaft of the motor 13. But the motor 13 is not arranged in a stationary manner against the motor frame 16. It is movable by means of rubber supports, such that its axis of rotation is able to execute, relative to the motor frame 16, both a slight transverse shift and an angular variation.

The compensation functions which have just been described are necessary not only for the removal of a drilling rod from the magazine, but also, and above all, for the placing in position and removal of a drilling rod with respect to the rod assembly 6.

Then the motor frame is brought back again, relative to the carriage 14, in the direction of the drilling axis 3, so that the drilling rod 7*c*, which now bears on the threaded sleeve 34, is taken from the magazine 19. The drilling rod (which in FIG. 1*a* is shown, in this transport position, as a rod 7*d*) is then moved downwards as far as the drilling axis 3.

By displacement of the motor frame 16 forwards with respect to the carriage 14 (that is to say, towards the left in FIG. 1*a* in step 4*c*), the forward end 27 of this rod is brought into contact with the rear end of the last drilling rod of the assembly 6 already located in the drilled hole, as can be seen in FIG. 3. Owing to the simultaneous rotation of the motor 13, this new drilling rod is screwed at the rear onto the rod assembly, thus prolonging the latter.

The screwing operation is carried out until a torque detector, coupled to the motor 13, indicates a sufficient degree of torque. During the screwing operation, the last rod of the assembly 6 is clamped, fixed in rotation by means of the rotating jaw 33 (step 4*c*) which is then in a position pushed a relatively long way towards the left, preferably at the rear end of the preceding rear element (7*b* in step 4*c*). After the end of the rotation of the motor 13, the rotating jaw 33 is loosened (step 4*d*) and the drilling drive device 9 (see FIG. 1*a* and FIG. 3) is brought back towards the right, along its two guides 29, until the rotating jaw 33 is located in the region of the last new rod 7 which has been connected, and it can be clamped by the rotating jaw 33, in order to detach from the drilling rod 7 which has just been connected to the threaded sleeve 34, by reverse rotation of the motor 13 (step 4*e*).

During this loosening of the jaw 33 and during the return of the drilling drive device 9, the rod assembly 6 is maintained in the position in which it was located until now, both axially and in rotation, relative to the drilled hole 1, by the fact that the jaw 21, fixed in the vicinity of the drilled hole against the drilling tower 11, clamps the rod assembly 6 (steps 4*a* to 4*e*). During the unscrewing of the threaded sleeve 34, the motor frame 16 is displaced towards the rear, relative to the carriage 14, once again horizontally by means of the hydraulic piston 37.

After loosening of the jaw 21, forward displacement of the whole of the device 9 makes it possible to displace the rod assembly 6 forwards by the length of the new drilling rod 7, owing to the fact that the whole of the drilling drive device 9 is pushed forwards, along the guides 29, by means of the hydraulic pistons 30, preferably arranged on the two lateral sides of the drilling tower 11 (force of approximately 2 tonnes). In order to adjust the direction, the rod assembly, before or during its advance, is optionally rotated slightly about the drilling axis 3 by means of the rotating jaw 33 (step 4*f*). Before, during or after this displacement of the device 9, the whole of the rod loader/extractor 12 is again displaced upwards, in order to seek out the following drilling rod 7 in the magazine 19 (step 4*g*). By repeating this operation, the rod assembly 6 is brought to the required length, and thus the drilled hole 1 advances in a controlled manner to its final point.

Since the rod assembly 6 is maintained by the drilling drive device 9 only by means of a dynamic connection, both for axial displacement and for rotational displacement, it may occur that, in an undesirable manner, the rod assembly 6 slips relative to the jaws 33 or 21.

In order to detect, and then make it possible to correct the position, at least one sensor 28, but preferably three sensors (designated as first, third and fourth detection means) 28*a*, 28*b*, 28*c*, are arranged against the drilling drive device 9, preferably against its housing 35. These sensors 28, which are preferably designed as inductive sensors, monitor the relative axial position with respect to the drilling rod 7 located in the region of the drilling drive device 9, owing to the fact that one of the sensors 28*a* reacts when the annular groove (designated as second detection means) 18 of this threaded rod 7 is exactly in front of it. If the rod assembly 6 slips in the direction of the drilling axis 3 relative to the drilling drive device 9, the annular groove 18 leaves the region of this sensor 28*a*, and the latter emits an error signal.

Figure 5:
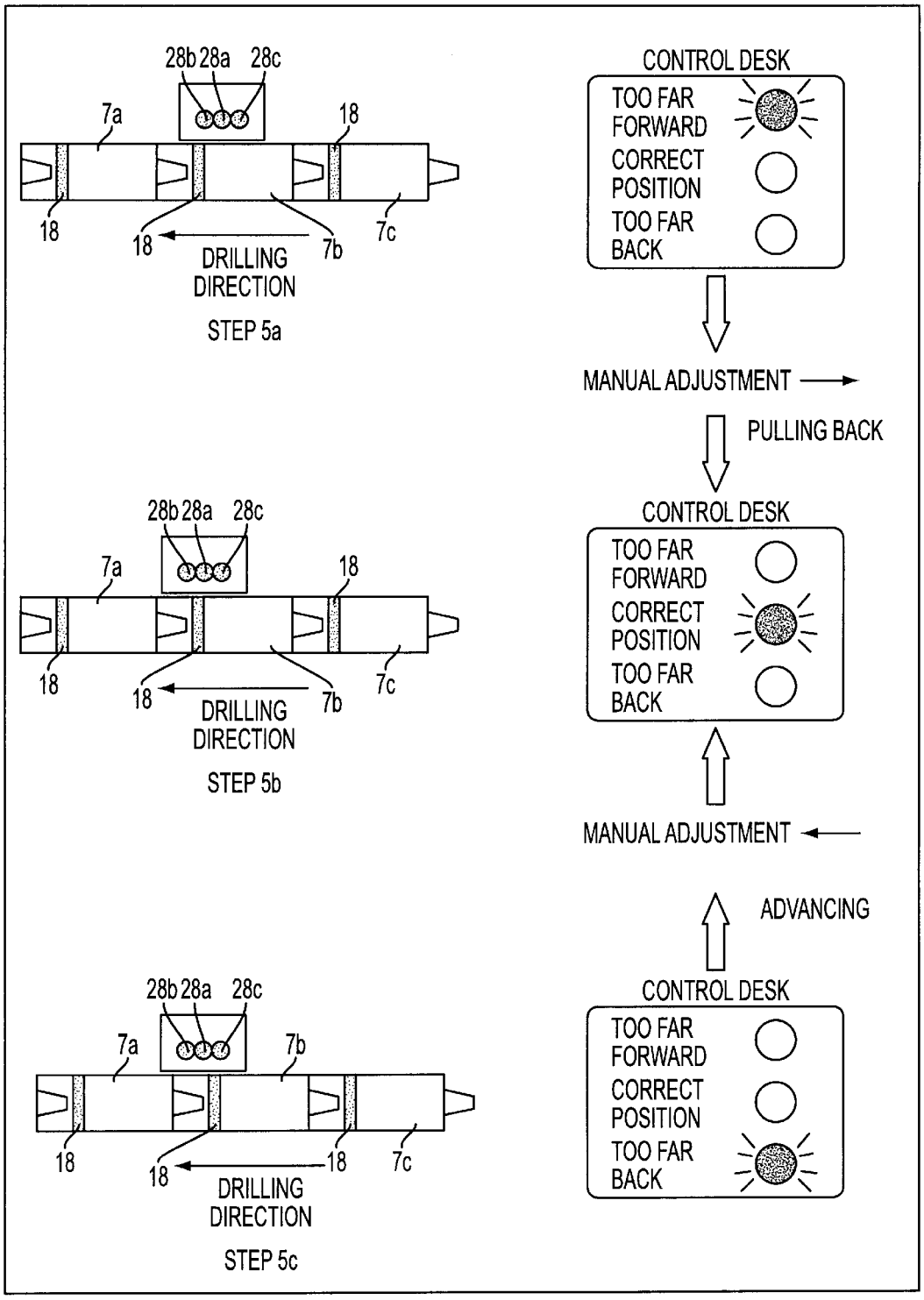
FIG. 5 is a block diagram of the operation of the device of the present invention (separated into steps 5*a*, 5*b* and 5*c*), detailing in particular the means for detecting the axial position and any possible slipping of the rod assembly relative to the drilling drive device.
Figure 6:
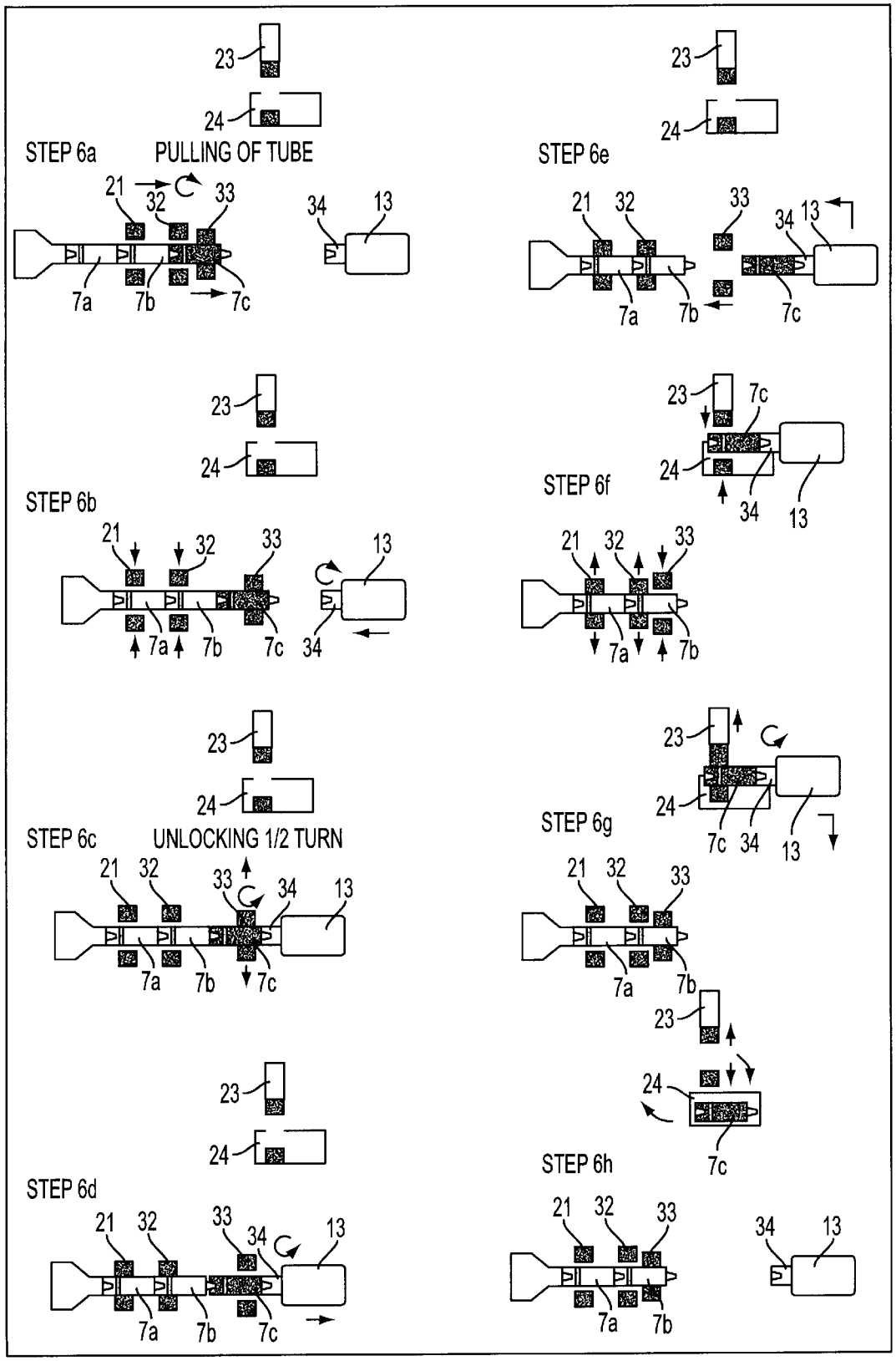
FIG. 6 is a block diagram of the operation of the process using the device of the invention for an operation of withdrawal of drilling rod elements, separated into the steps 6*a* to 6*h*.

These different possibilities are clearly shown in FIG. 5, where three steps 5*a* to 5*c* are shown. "FRONT" and "BACK" show the respective front and back ends or elements.

In step 5*a*, it can be seen that the drilling rod assembly is too far forward in the drilled hole, since the groove 18 of the element 7*b* has passed the detection means 28*a* and has been registered by the detection means 28*b*.

In step 5*b*, it can be seen that the drilling rod assembly is in the correct position, since the detection means 28*a* is located opposite the groove 18 of the element 7*b*.

Finally, in step 5*c*, it can be seen that the drilling rod assembly is too far back relative to the drilling drive device, since the groove 18 of the element 7*b* is set back relative to the detection means 28*a*, and has been registered by the detection means 28*c*.

Each time, in steps 5*a* and 5*b*, in order to bring the drilling rod assembly into the correct position illustrated in step 5*b*, it is sufficient to pull back or advance the drilling drive device 9 along the drilling axis in order to advance or pull back the drilling rod assembly in the hole so as to bring the detection means 28*a* opposite the registering means 18 (the groove) of the element 7*b*.

As the other two sensors 28*b*, 28*c* are arranged in the vicinity of one another on the two sides in the direction of the drilling axis 3, the annular groove 18 should have passed one of the two sensors 28*b*, 28*c*, which has produced a corresponding signal. As a result, the direction of displacement of the rod assembly 6 relative to the drilling drive device 9 is known and, preferably after the rod assembly 6 has been fixed in the drilled hole 1 by means of the clamping jaw 21 fixed in a stationary manner against the drilling tower, the drilling drive device 9 is displaced again in the direction of the drilling axis 3, so that the sensor 28*a* is opposite the annular groove 18, that is to say, reassumes the prescribed position.

The procedure is as follows for removing the rod assembly 6 from the drilled hole 1, by retraction as described in steps 6*a* to 6*h* in FIG. 6:

First of all, there is provided in the drilling drive device 9 a scraper, not shown, constituted most often by one or more rubber lips or by a rubber bush, for roughly cleaning the rod assembly 6 withdrawn from the drilled hole 1.

At the start of the return operation, the clamping jaw 33 of the drilling drive device 9 holds the rearmost drilling rod of the rod assembly 6 (the element 7*c* in step 6*a*), in which case the drilling drive device 9 is in the forward position relative to the drilled hole 1, at the left-hand edge of the starting shaft 2 in FIG. 1*a*.

From this position, the drilling drive device 9 is brought towards the right (step 6*b*), by the length of a drilling rod 7, then the rod assembly 6 is fixed in the drilled hole 1 by the fact that the clamping jaw 21 arranged against the drilling tower 11 fixes that rod of the rod assembly 6 which is now the last but one, or another rod arranged further forwards (step 6*c*).

Then the last rod but one of the rod assembly 6 is clamped by the separating/unlocking jaw 32 (step 6*c*). The threaded sleeve 34 is then brought into a position of alignment with the drilling axis 3 and is screwed onto the rear end of the rod assembly 6 (step 6*c*), owing to the fact that the threaded sleeve 34 is rotated forwards, that is to say, as a general rule in a clockwise direction, while being displaced against the rear end of the assembly, until the sleeve and the last drilling rod 6 are screwed together sufficiently tightly. This is verified by monitoring of the torque.

The rotating jaw 33 is then subjected to rotation about the drilling axis 3 (step 6*c*), through approximately a half turn towards the left (direction of opening of the screw thread) so that the last rod and the last rod but one of the rod assembly 6 are partially unscrewed.

The rotating jaw 33 then disengages this last rod and is displaced forwards against the drilled hole 1, to grasp that rod of the assembly 6 which is now the last, and again withdraw it from the drilled hole until it can be removed from the rod assembly 6, as stated above. Simultaneously, or a little after, the unscrewing operation is continued and completed by the threaded sleeve 34 and the motor 13, with the threaded rod which is located there (which was initially the last), by rotation of the screw thread in the opposite direction (rotation to the left), and simultaneously, during the displacement of the rod changer towards the rear, by moving away from the rod assembly (step 6*d*). Before this, or at the same time, the drilling rod located on the threaded sleeve 34 is carried into the gripping region of the gripper device 23 located in the upper region of the drilling tower 11, by raising of the carriage 14 and optionally simultaneous displacement towards the left of the motor frame 16 relative to the carriage 14 (step 6*e*). To this end, the magazine 19 must be withdrawn from the vertical trajectory of the drilling rod by being raised or lowered. At all events, before reaching the gripper device 23, the drilling rod thus transported bears on the pivoting chute 24 in order to move it away from its trajectory.

After closure of the gripper device 23 (step 6*f*) by means of its piston 23', the drilling rod 7*k*, as can be seen in FIG. 2*b*, is held by the gripper device 23. The threaded sleeve 34 can then be loosened by rotation in the reverse direction of the motor 13 (step 6*g*), and by simultaneous rearward displacement of the motor frame 16 relative to the carriage 14.

Under the action of the opening of the gripper device 23, the drilling rod 7*k* drops into the inclined chute 24, which, under the effect of the force of gravity, has remained at the rear in FIG. 2*b*, and it rolls along this chute, moving laterally away from the drilling tower 11, for subsequent handling by the operating personnel (step 6*h*).

Simultaneously, or afterwards, the loader/extractor 12 is displaced downwards in order to take up the following rod of the rod assembly 6 (step 6*g*).

We claim:

1. An apparatus for drilling a horizontal borehole from a pit dug in the ground, comprising:

a framework adapted to be lowered, at least in part, into the pit, the framework having a length, a plurality of drilling rod elements to be arranged end to end along an axis thereby constituting a train of drilling rods having a common axis and suitable for being pushed forward through the ground in a drilling direction to create a borehole, each rod element having a determined length, a drilling drive means horizontally movable in the framework between a forward position and a rear position, in order to drive the drilling rod elements and to create, while advancing, said train of drilling rod elements which is relatively rigid along a substantially horizontal drilling axis, said train having a rear element and a front element, said determined length of each drilling rod element constituting the train of drilling rod elements being less than said length of the framework, wherein the apparatus also comprises first clamping means disposed laterally relative to each drilling rod element and affixed to the drilling drive means so that the first clamping means and the drilling drive means cooperate to simultaneously push and rotate said train of drilling rod elements substantially along said substantially horizontal drilling axis until a borehole is formed in the ground.

2. The apparatus according to claim 1, wherein the clamping means clamps a periphery of the rear drilling rod element in order to advance the train of drilling rod elements along the drilling axis.

3. The apparatus according to claim 1, further comprising detection means comprising a first detection means fixed in the framework and co-operating with a series of second detection means disposed on each drilling rod element for determining a relative axial position of the train of drilling rod elements with respect to the drilling drive means during an axial displacement of the train of drilling rod elements.

4. The apparatus according to claim 3, wherein the detection means further comprises third and fourth detection means fixed to the framework and co-operating with the series of second means in order to determine a direction of any possible slipping of the train of drilling rod elements relative to the drilling drive device during the axial displacement of the train of drilling rod elements.

5. The apparatus according to claim 1, wherein the drilling drive means comprises:

said first clamping means, thrust means for advancing the train of drilling rod elements by compression along the drilling axis, and loader/extractor means movable in the framework between a high position and a low position in order to bring additional rod elements to the drilling drive means for lengthening the train of drilling rod elements when the borehole is to be drilled and for removing elements from the train of drilling rod elements, when the hole is drilled.

6. The apparatus according to claim 5, wherein in the high position, the loader/extractor means receives one of said elements from a rod element magazine in which said rod elements are arranged substantially horizontally.

7. The apparatus according to claim 1, wherein it further comprises second clamping means for clamping the drilling rod element adjoining the rear drilling rod element and unlocking means for unlocking the drilling rod element adjoining the rear drilling rod element in order to allow their relative disconnection.

8. Apparatus for drilling a horizontal borehole, comprising:

a drill tower adapted to be lowered into a vertical pit, said drill tower including:

a magazine containing a plurality of drill rod elements, each drill rod element having a screw threads at each end thereof, a horizontally movable drive mechanism for clamping a drill rod element and driving said drill rod element into a horizontal borehole in said pit, and a loader/extractor having a motor coupled to a threaded sleeve and being movable from a first position at which said threaded sleeve is aligned with a drill rod element in said magazine and screwed to said drill rod element by rotation of said motor, to a second position at which a drill rod element coupled to said sleeve is clamped by said drive mechanism and screwed onto a preceding drill rod element protruding from said borehole to form a drill rod train, wherein said drive mechanism contains first gripping means for gripping a terminal drill rod element of said drill rod train while said sleeve-coupled drill rod element is screwed thereon by rotation of said motor, and second gripping means for gripping said drill rod train while said first gripping means is released, said drive mechanism being moved to a position at which said first gripping means grips the drill rod element added to said drill rod train and pushes said drill rod train into said borehole through horizontal movement of said drive mechanism.

* * * * *